US009199383B2

(12) United States Patent
Shimizu et al.

(10) Patent No.: US 9,199,383 B2
(45) Date of Patent: Dec. 1, 2015

(54) BLADE OF RECIPROCATING ELECTRIC SHAVER

(75) Inventors: Hiroaki Shimizu, Hikone (JP); Shunsuke Komori, Hikone (JP); Takeshi Shiba, Hikone (JP); Jyuzaemon Iwasaki, Nagahama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 642 days.

(21) Appl. No.: 12/663,401

(22) PCT Filed: Jul. 3, 2008

(86) PCT No.: PCT/JP2008/062092

§ 371 (c)(1),
(2), (4) Date: Dec. 7, 2009

(87) PCT Pub. No.: WO2009/008332

PCT Pub. Date: Jan. 15, 2009

(65) Prior Publication Data

US 2010/0180446 A1 Jul. 22, 2010

(30) Foreign Application Priority Data

Jul. 12, 2007 (JP) ..... 2007-183623

(51) Int. Cl.
*B26B 19/04* (2006.01)

(52) U.S. Cl.
CPC ..... *B26B 19/04* (2013.01)

(58) Field of Classification Search
CPC ..... B26B 19/00; B26B 19/02; B26B 19/04; B26B 19/046; B26B 19/048; B26B 19/12; B26B 19/38; B26B 19/3846; B26B 19/386
USPC ..... 30/43.7–43.92, 346.51
See application file for complete search history.

(56) References Cited

U.S. PATENT DOCUMENTS

| | | | | | |
|---|---|---|---|---|---|
| 2,629,169 | A | * | 2/1953 | Kleinman | 30/43.92 |
| 4,274,199 | A | * | 6/1981 | Gallanis et al. | 30/34.1 |
| 4,837,929 | A | * | 6/1989 | Tanahashi et al. | 30/43.92 |
| 4,926,552 | A | * | 5/1990 | Otsuka et al. | 30/43.92 |
| 5,463,813 | A | * | 11/1995 | Otsuka et al. | 30/43.9 |
| 5,539,984 | A | * | 7/1996 | Ikuta et al. | 30/43.92 |
| 5,943,777 | A | * | 8/1999 | Hosokawa et al. | 30/43.92 |

(Continued)

FOREIGN PATENT DOCUMENTS

| | | | | |
|---|---|---|---|---|
| JP | 06071061 | A | * | 3/1994 |
| JP | 06182062 | A | * | 7/1994 |

(Continued)

OTHER PUBLICATIONS

Russian Office Action that issued with respect to Russian Patent Application No. 2010100830, mailed Sep. 17, 2010, along with an English language translation thereof.

*Primary Examiner* — Jason Daniel Prone
(74) *Attorney, Agent, or Firm* — Greenblum & Bernstein, P.L.C.

(57) ABSTRACT

A blade of a reciprocating electric shaver includes a newly provided guide frame freely detachably held on a holding frame provided on a shaver body, in which, in the guide frame, there are provided: coupling portions to which an outer edge frame that fixes an outer edge thereto is coupled; and spring receiving portions which support lower ends of inner edge push-up springs.

12 Claims, 8 Drawing Sheets

(56) References Cited

U.S. PATENT DOCUMENTS

| | | | | |
|---|---|---|---|---|
| 5,946,806 | A | 9/1999 | Watanabe et al. | |
| 6,073,348 | A * | 6/2000 | Shiba | 30/43.92 |
| 6,219,920 | B1 | 4/2001 | Klein | |
| 6,293,017 | B1 * | 9/2001 | Sato et al. | 30/43.92 |
| 7,464,471 | B2 * | 12/2008 | Fukutani et al. | 30/43.91 |
| 7,690,117 | B2 * | 4/2010 | Rogatschnig | 30/43.2 |
| 7,707,726 | B2 * | 5/2010 | Shiba | 30/43.92 |
| 7,818,884 | B2 * | 10/2010 | Royle et al. | 30/43.91 |
| 2004/0010919 | A1 * | 1/2004 | Shiba et al. | 30/43.92 |
| 2004/0163260 | A1 | 8/2004 | Uchiyama | |
| 2004/0231160 | A1 * | 11/2004 | Shiba et al. | 30/43.92 |
| 2004/0237310 | A1 | 12/2004 | Shiba et al. | |
| 2005/0138821 | A1 * | 6/2005 | Tsushio et al. | 30/527 |
| 2005/0198827 | A1 * | 9/2005 | Andrew et al. | 30/346.51 |
| 2005/0262695 | A1 * | 12/2005 | Ouchi et al. | 30/43.92 |
| 2006/0021227 | A1 * | 2/2006 | Shiba et al. | 30/43.92 |
| 2006/0021228 | A1 * | 2/2006 | Shiba et al. | 30/43.92 |
| 2006/0085984 | A1 * | 4/2006 | Oh | 30/43.92 |
| 2006/0085985 | A1 * | 4/2006 | Oh | 30/43.92 |
| 2006/0137187 | A1 * | 6/2006 | Fukutani et al. | 30/43.92 |
| 2006/0150421 | A1 * | 7/2006 | Sato et al. | 30/43.91 |
| 2006/0265880 | A1 * | 11/2006 | Sagawa | 30/43.92 |
| 2007/0022607 | A1 * | 2/2007 | Takeuchi et al. | 30/43.92 |
| 2007/0124938 | A1 * | 6/2007 | Oh | 30/43.92 |
| 2007/0245565 | A1 * | 10/2007 | Sato et al. | 30/43.92 |
| 2007/0261249 | A1 * | 11/2007 | Yamasaki et al. | 30/43.7 |
| 2008/0016694 | A1 * | 1/2008 | Sato et al. | 30/43.92 |
| 2008/0134514 | A1 * | 6/2008 | Iwasaki et al. | 30/43.91 |
| 2008/0134515 | A1 * | 6/2008 | Sato et al. | 30/43.91 |
| 2008/0134523 | A1 * | 6/2008 | Komori et al. | 30/346.51 |
| 2008/0209736 | A1 * | 9/2008 | Shiba | 30/43.92 |
| 2009/0133266 | A1 * | 5/2009 | Eichhorn et al. | 30/43.7 |
| 2009/0241343 | A1 * | 10/2009 | Yamasaki et al. | 30/43.92 |
| 2010/0175263 | A1 * | 7/2010 | Shimizu et al. | 30/43.92 |
| 2010/0180447 | A1 * | 7/2010 | Sato et al. | 30/43.92 |
| 2010/0180448 | A1 * | 7/2010 | Sato et al. | 30/43.92 |
| 2010/0269350 | A1 * | 10/2010 | Iwashita | 30/43.92 |
| 2010/0325893 | A1 * | 12/2010 | Komori et al. | 30/43.92 |
| 2012/0005899 | A1 * | 1/2012 | Takaoka et al. | 30/43.91 |

FOREIGN PATENT DOCUMENTS

| | | | |
|---|---|---|---|
| JP | 06190157 | A * | 7/1994 |
| JP | 06327852 | A * | 11/1994 |
| JP | 06335572 | A * | 12/1994 |
| JP | 10-80583 | | 3/1998 |
| JP | 10-235033 | | 9/1998 |
| JP | 11-42378 | | 2/1999 |
| JP | 2001-347082 | | 12/2001 |
| JP | 2004-254757 | | 9/2004 |
| JP | 2005-73939 | | 3/2005 |
| RU | 2068338 | | 10/1996 |
| RU | 2121432 | | 11/1998 |
| RU | 2122491 | | 11/1998 |

* cited by examiner

Prior Art (a)

BLADE OF RECIPROCATING ELECTRIC SHAVER

TECHNICAL FIELD

The present invention relates to a blade of a reciprocating electric shaver, and specifically, relates to a technology for coupling an outer member and an outer member frame to each other independently of an inner member block.

BACKGROUND ART

Heretofore, for example as shown in FIG. 1, as a slit member of a reciprocating electric shaver, which is for use in rough shaving, a slit member is known, which includes: an outer member 1A; an outer member frame 2A that fixes the outer member 1A thereto; an inner member 3A arranged on a lower surface of the outer member 1A; an inner member joint 4A that couples the inner member 3A to a drive side; and inner member push-up springs 5A which press the inner member 3A toward an inner surface of the outer member 1A. Moreover, for example as disclosed in Japanese Patent Laid-Open Publication No. H11-42378 (hereinafter, written as Patent Literature 1), the outer member 1A is fixed to the outer member frame 2A in a heat-sealed manner in a state where lower ends of the inner member push-up springs 5A are supported by spring receiving portions 10A provided on the outer member frame 2A, and where the inner member joint 4A is supported by upper ends of the inner member push-up springs 5A, whereby a slit member block is assembled.

However, in Patent Literature 1 described above, in the event of fixing the outer member 1A to the outer member frame 2A, the outer member 1A has had to be fixed to the outer member frame 2A in the heat-sealed manner against spring urging force F of the inner member push-up springs 5A. Therefore, though it is possible to perform an assembly process for an outer member 1A with high rigidity, there has been a disadvantage that an assembly process for an outer member 1A with low rigidity cannot be performed well since the outer member 1A is deformed by the spring urging force.

[Patent Literature 1] Japanese Patent Laid-Open Publication No. H11-42378

DISCLOSURE OF INVENTION

Technical Problem

The present invention has been invented in consideration of the above conventional problem. It is an object of the present invention to provide a blade of a reciprocating electric shaver, which uses a new guide frame for enabling even the outer member with low rigidity can be assembled with a holding frame.

Technical Solution

In order to achieve the above-described object, a blade of a reciprocating electric shaver, which has an outer member 1, an outer member frame 2 that fixes the outer member 1 thereto, an inner member 3 arranged under a lower surface of the outer member 1, an inner member joint 4 that couples the inner member 3 to a drive side, and inner member push-up springs 5 which press the inner member 3 toward an inner surface of the outer member 1, includes: a guide frame 8 freely detachably held on a holding frame 7 provided on a shaver body, wherein, in the guide frame 8, there are provided: coupling portions 9 to which the outer member frame 2 that fixes the above-described outer member 1 thereto is coupled; and spring receiving portions 10 which support lower ends of the above-described inner member push-up springs 5.

As described above, the new guide frame 8 that has not existed heretofore, that is, the guide frame 8 capable of coupling the outer member frame 2 that fixes the outer member 1 thereto to the coupling portions 9, and of supporting the lower ends of the inner member push-up springs 5 by the spring receiving portions 10 is used. In such a way, it becomes possible to easily assemble an outer member block 6A composed of the outer member 1 and the outer member frame 2 and an inner member block 6B composed of the inner member 3, the inner member joint 4 and the inner member push-up springs 5 with each other by using the guide frame 8 concerned. In addition, assembly of the outer member block 6A can be carried out in a state where spring urging force from the inner member push-up springs 5 of the inner member block 6B is not applied thereto. Accordingly, even if an outer member 1 with low rigidity is used, it becomes possible to couple the outer member 1 concerned to the outer member frame 2 without deforming the outer member 1, and it becomes easy to assemble the outer member block 6A in the case of using the outer member 1 with low rigidity.

Moreover, it is preferable that pressing portions 11 which protrude from a front surface of the outer member 1 be individually provided on upper portions on both ends of the outer member frame 2 in a longitudinal direction A that goes along a reciprocating direction of the above-described inner member 3, and the outer member frame 2 be pressed through the pressing portions 11, whereby it be made possible to couple the outer member frame 2 that fixes the outer member 1 thereto to the coupling portions 9 of the guide frame 8. In such a way, it becomes possible to couple the outer member 1 to the outer member frame 2 without directly pushing the outer member 1, and accordingly, the outer member 1 does not become deformed, and it becomes much easier to assemble the outer member block 6A.

Moreover, it is preferable that the coupling portions 9 be individually arranged on both ends of the guide frame 8 in a longitudinal direction A that goes along a reciprocating direction of the above-described inner member 3, and both ends of the outer member frame 2 in the longitudinal direction A be coupled to the coupling portions 9. In such a way, thinning of the guide frame in a front-and-rear direction B perpendicular to the longitudinal direction A thereof can be achieved.

Moreover, in the above-described guide frame 8, it is preferable that a pair of frame portions 12 located on both ends thereof in a longitudinal direction A and a coupling portion 13 that couples the pair of frame portions 12 to each other be formed integrally with one another, and the coupling portion 9 and the spring receiving portion 10 be provided on each of the frame portions 12. In such a way, strength of the guide frame 8 is enhanced by the integration of the pair of frame portions 12 and the coupling portion 13, coupling strength of the outer member frame 2 to the guide frame 8 is increased following this enhancement, and reliability in assembling the guide frame 8 and the outer member frame 2 with each other can be enhanced.

Moreover, it is preferable that the above-described guide frame 8 be composed of a right and left pair of frame portions 12 separate from each other, and the coupling portion 9 and the spring receiving portion 10 be provided on each of the frame portions 12. In such a way, downsizing of the guide frame 8 is achieved by separation thereof, and following this downsizing, it becomes easy to assemble the guide frame 8 with the outer member block 6A and the inner member block 6B.

Moreover, it is preferable that the above-described coupling portion 13 be composed of plural walls 13*a* and 13*b* individually arranged on both sides of the guide frame 8 in a front-and-rear direction perpendicular to the longitudinal direction A thereof. In such a way, it becomes possible to sandwich both front and rear surfaces of the outer member frame 2 by the front and rear walls 13*a* and 13*b*, and the coupling strength of the outer member frame 2 to the guide frame 8 is further enhanced.

Moreover, it is preferable that the plural walls 13*a* and 13*b* individually arranged on both sides of the guide frame 8 in the above-described front-and-rear direction B be arranged at heights different from each other in a vertical direction. In such a way, it becomes possible to sandwich both front and rear surfaces of the outer member frame 2 by the front and rear walls 13*a* and 13*b* different in height from each other, whereby stability in coupling the outer member frame 2 to the guide frame 8 is enhanced in addition to the enhancement of the coupling strength of the outer member frame 2 thereto, further, it becomes easy to insert the outer member frame 2 into an opening portion made by the front and rear walls 13*a* and 13*b* different in height from each other, and it becomes much easier to assemble the guide frame 8 with the outer member block 6A and the inner member block 6B.

Moreover, it is preferable that at least one wall 13*b* of the plural walls 13*a* and 13*b* individually arranged on both sides of the guide frame 8 in the above-described front-and-rear direction B be arranged along a side surface of the outer member 1. In such a way, in addition to the enhancement of the coupling strength of the outer member frame 2 to the guide frame 8, it becomes possible to prevent the skin from strongly touching the outer member 1 by the wall 13*b* arranged along the side surface of the outer member 1 at the time of shaving.

Moreover, it is preferable that cover portions 15 which cover gaps 14 between the outer member frame 2 and the guide frame 8 from above be protruded on both ends of the outer member frame 2 in a longitudinal direction A that goes along a reciprocating direction of the above-described inner member 3. In such a way, the gaps 14 between the guide frame 8 and the outer member frame 2 are covered with the cover portions 15, whereby beard comes not to enter depths of the gaps 14 concerned. As a result, it becomes possible to prevent "beard pulling" at the time of shaving.

Moreover, it is preferable that holes 16 open downward be provided in vicinities of the spring receiving portions 10 of the above-described guide frame 8. In such a way, beard waste drops down from the holes 16. Accordingly, the beard waste can be prevented from being accumulated in an inside of the guide frame 8, and in addition, an attached state of the inner member push-up springs 5 can be easily confirmed from below the holes 16.

Moreover, it is preferable that holes 17 open in a front-and-rear direction of the above-described guide frame 8 be provided in vicinities of the spring receiving portions 10 of the guide frame 8. In such a way, the beard waste is discharged in the front-and-rear direction B from the holes 17. Accordingly, the beard waste can be prevented from being accumulated in the inside of the guide frame 8, and in addition, the attached state of the inner member push-up springs 5 can be easily confirmed from the front-and-rear direction B through the holes 17.

Moreover, it is preferable that the holding frame 7 provided on the above-described shaver body have a function to inhibit an expansion of the guide frame 8 in a longitudinal direction A that goes along a reciprocating direction of the inner member 3. In such a way, the expansion of the guide frame 8 in the longitudinal direction A can be stopped by using the holding frame 7 in a state where the guide frame 8 is held on the holding frame 7. Accordingly, reliability can be enhanced in assembling the guide frame 8 with the outer member block 6A and the inner member block 6B.

Advantageous Effect of the Invention

In accordance with the present invention, the new guide frame is used, whereby it becomes possible to couple the outer member and the outer member frame to each other in a state where the spring urging force is not applied thereto. Accordingly, it becomes possible to couple even the outer member with low rigidity to the holding frame, and the assembly of the outer member can be carried out with ease.

BRIEF DESCRIPTION OF THE DRAWINGS

FIG. 3(*a*) is an exploded perspective view of a blade block composed by using a guide frame; and FIG. 3(*b*) is a perspective view of a holding frame that holds the blade block.

FIG. 4(*a*) is a schematic configuration view of a state where an outer member is fixed to an outer member frame; and FIG. 4(*b*) is a schematic configuration view of a state where the outer member frame that fixes the outer member thereto is attached to the guide frame, and where the guide frame is held on the holding frame.

FIG. 7(*a*) is a schematic configuration view of a case where the guide frame is integrally molded; and FIG. 7(*b*) is a schematic configuration view of a case where the guide frame is separated right and left.

FIG. 8(*a*) is a schematic configuration view showing a case where two front and rear walls which compose the coupling portion for an inner member joint are arranged at the same height; FIG. 8(*b*) is a schematic configuration view showing a case where the two front and rear walls are arranged at heights different from each other in the vertical direction; and FIG. 8(*c*) is a schematic configuration view showing a case where the one wall on the rear side is arranged along a side surface of the outer member.

FIG. 10(*a*) is a perspective view of a vicinity of the cover portion of FIG. 9; and FIG. 10(*b*) is an enlarged perspective view of a portion E of FIG. 10(*a*).

BEST MODE FOR CARRYING OUT THE INVENTION

A description will be made below of the present invention based on embodiments shown in the accompanying drawings.

First Embodiment

Figure 1:
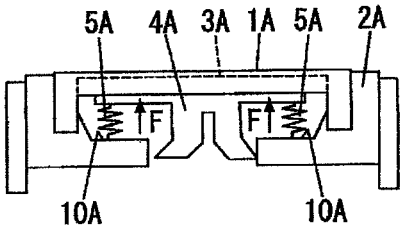
FIG. 1 is an explanatory view of a conventional example.
Figure 2:
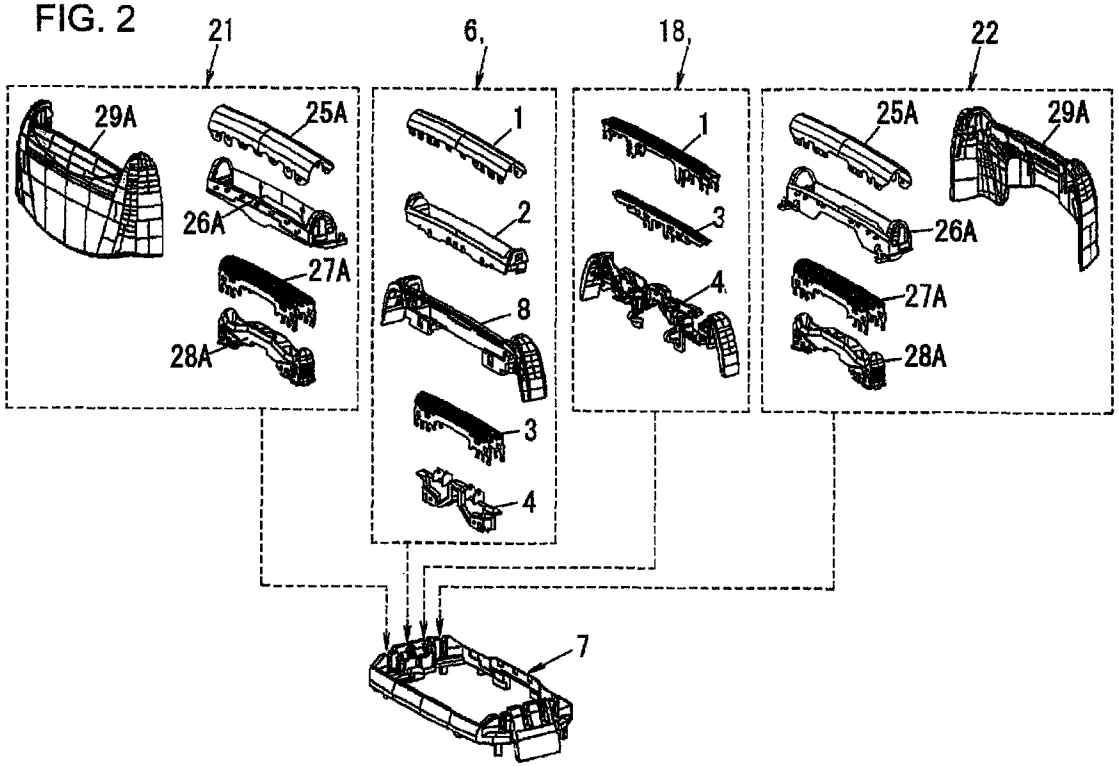
FIG. 2 is an exploded perspective view explaining a case, in a case where the number of blade heads of a reciprocating electric shaver is four, where one of the blade heads is composed of an auxiliary blade head using a guide frame.

Onto a head portion of a reciprocating electric shaver according to this embodiment, for example as shown in FIG. 2, four blade heads freely floatable independently of one another are attached freely detachably. Among them, two auxiliary blade heads are arranged side by side in the center of the head portion, and two arch-like main blade heads 21 and 22 for finish shaving are individually arranged on both outsides of the head portion.

In FIG. 2, as heretofore, each of the two finish shaving main blade heads 21 and 22 is composed of an outer member 25A, an outer member frame 26A, an inner member 27A, an inner member joint 28A, an outer member cover 29A, and the like.

Moreover, one of the two auxiliary blade heads is composed of an arch-like finish shaving blade block 6, and the other is composed of a blade block 18 for rough shaving, which includes a slit member 1A, an inner member 3A, an inner member joint 4A, and the like.

A description will be made below of the finish shaving blade block 6 that composes the auxiliary blade head. Note that, in the following, a direction where an inner member 3 reciprocates is defined as a longitudinal direction A or a right-and-left direction, and a direction perpendicular to this direction is defined as a front-and-rear direction B.

Figure 3:
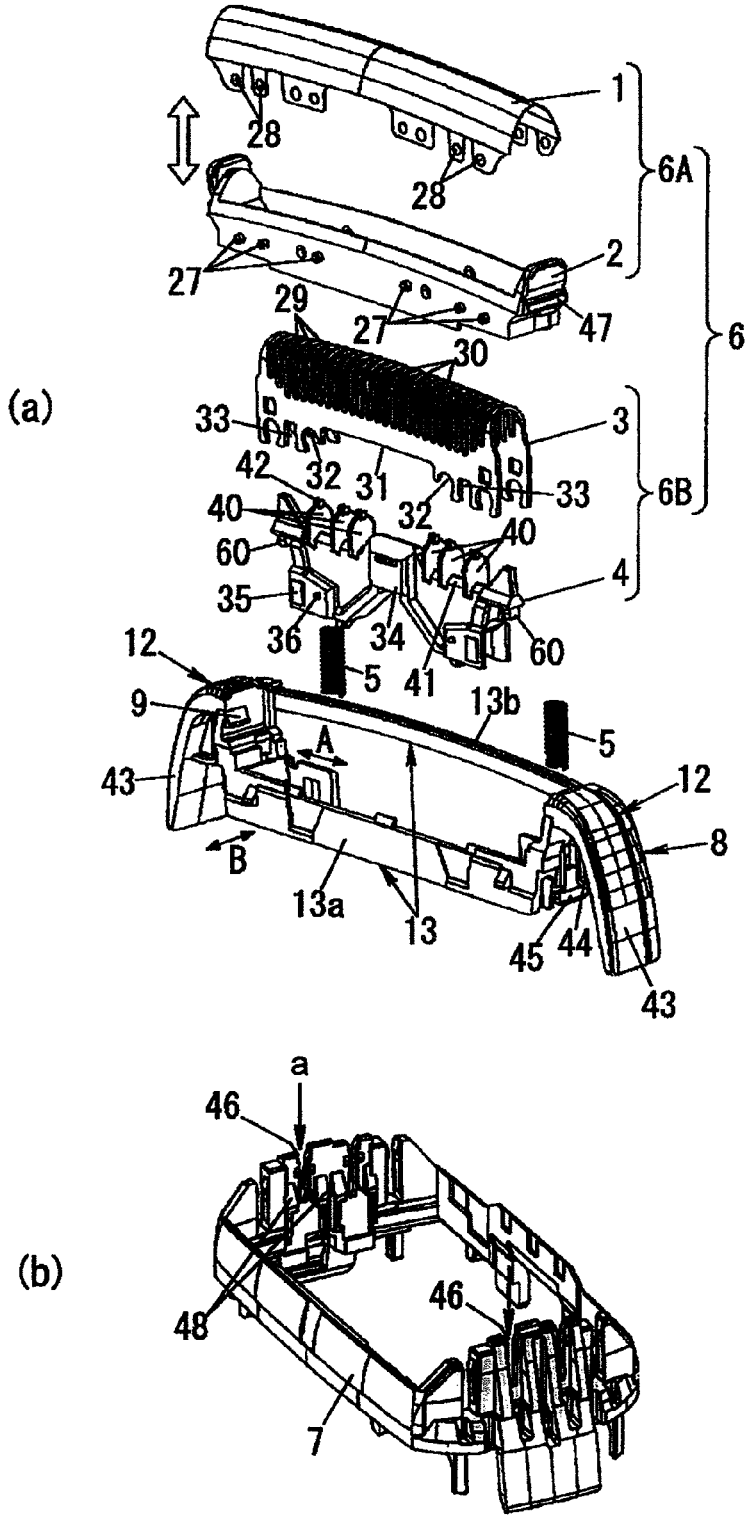
FIG. 3 shows a first embodiment of the present invention.

As shown in FIG. 3, this finish shaving blade block 6 is composed of: an outer member block 6A formed of an outer member 1 (net member) made of a thin metal sheet having a large number of holes, and an outer member frame 2 that fixes the outer member 1 thereto; and an block 6B formed of the inner member 3 arranged under a lower surface of the outer member 1, an inner member joint 4 that couples the inner member 3 to a drive side, and inner member push-up springs 5 which press the inner member 3 toward an inner surface of the outer member 1.

On lower end portions on both front and rear sides of the above-described outer member frame 2, heat seal bosses 27 are individually protruded. Moreover, the outer member 1 and the outer member frame 2 are fixed to each other in a heat-sealed manner in a state where engagement holes 28 individually provided on lower end portions on both front and rear sides of the outer member 1 are fitted to the heat seal bosses 27 by bowing the outer member 1 into an arch shape, whereby the outer member block 6A is assembled.

The inner member 3 is formed in such manner that sheet metal is subjected to press bending and the entirety thereof is formed into an arch shape. Moreover, in an upper portion of the inner member 3, which forms a substantially circular-arc protruding shape in cross section, plural member pieces 30 which have an inverse U shape and are formed by forming plural slit holes 29 therein are arrayed. In lower portions extended individually downward from both front and rear lower ends of the inner member 3, notched portions 31 are individually recessed on centers thereof, circular recessed portions 32 which have a substantially circular shape and are open downward are individually recessed on both right and left sides of the notched portions 31, and further, square recessed portions 33 which have a substantially rectangular shape and are open downward are individually recessed on outsides of the circular recessed portions 32, which are also both right and left sides thereof.

In a center of a lower portion of the inner member joint 4, a coupling recessed portion 34 freely detachably coupled to a driver side of a shaver body is provided. On both wall surfaces of the inner member joint 4 in the front-and-rear direction B, prism-like square protruding portions 35 and cylindrical heat seal bosses 36 are protruded side by side. Then, the heat seal bosses 36 are heat-sealed in a state where the inner member joint 4 is inserted from below the inner member 3 into an inside thereof and the heat seal bosses 36 of the inner member joint 4 are fitted into and positioned to the circular recessed portions 32 of the inner member 3, whereby the inner member joint 4 is attached to the inner member 3. In addition, in the state where the inner member joint 4 is attached to the inner member 3, the prism-like square protruding portions 35 of the inner member joint 4 are fitted to the square recessed portions 33 of the inner member 3, whereby right-and-left positioning of the inner member 3 with respect to the inner member joint 4 is performed. Note that reference numerals 60 in FIG. 3 denote spring receiving portions.

Moreover, in FIG. 3, plural vibration plates 40 and one support portion 41 that supports these vibration plates 40 are provided on an upper portion of the inner member joint 4. The plural vibration plates 40 are vertically arranged below several (for example, four to six) member pieces 30 among the plural member pieces 30 provided on the inner member 3. The respective vibration plates 40 are individually formed into an inverse U shape bent along inner surfaces of the member pieces 30 having the inverse U shape. A right and left pair of protruding pieces 42 is provided on an upper end of a top portion of each of the vibration plates 40, and a lower surface of a top portion of one member piece 30 is sandwiched from right and left by the right and left pair of protruding pieces 42, whereby, separately from others, the upper ends of the vibration plates 40 and the lower surfaces of the top portions of the member pieces 30 are coupled to each other in the right-and-left direction (that is, the reciprocating direction of the inner member 3). Moreover, each lower end portion of the respective vibration plates 40 is molded integrally with the one support portion 41 of the inner member joint 4. Here, a "center single spot" support structure in which a lower end center of each of the vibration plates 40 is supported by a single spot is adopted, whereby a degree of freedom of each of the vibration plates 40 is enhanced. In such a way, a mechanism is made, in which, in the event where the member pieces 30 of the inner member 3 cut the beard at the time of shaving, the vibration plates 40 coupled to the member pieces 30 vibrate to generate a comfortable sound (shaving sound).

In the present invention, in the event of assembling the outer member block 6A and the inner member block 6B with each other, a new guide frame 8 is used, which is freely detachably held in a direction indicated by an arrow a of FIG. 3(*b*) on a holding frame 7 provided on the shaver body.

In this new guide frame 8, a pair of frame portions 12 located on both ends thereof in the longitudinal direction A and a coupling portion 13 that couples the pair of frame portions 12 to each other are formed integrally with one another. Moreover, coupling portions 9 are individually provided on inner surfaces of the pair of frame portions 12, guide protrusions 45 held on the holding frame 7 so as to be freely floatable are individually provided on outer surfaces of the respective frame portions 12, and spring receiving portions 10 are individually provided on a bottom surface portion of the guide frame 8, which is extended in the longitudinal direction A from lower ends of the respective frame portions 12.

Moreover, cover pieces 43 are individually provided on outer side surfaces of the respective frame portions 12. Longitudinal ribs 44 (refer to FIG. 11) are formed on inner surfaces of the respective cover pieces 43, and guide protrusions 45 (refer to FIG. 11) are protruded on outer surfaces of the frame portions 12, which are opposite to the cover pieces 43. Meanwhile, on the holding frame 7, there are provided: recessed grooves 46 which are open upward and into which the above-described longitudinal ribs 44 are inserted from above (in the direction of the arrow a of FIG. 3(*b*)); and engagement protrusions 48 with which the guide protrusions 45 engage. Then, the guide protrusions 45 are engaged with the engagement protrusions 48 in a state where the longitudinal ribs 44 of the respective frame portions 12 are made freely floatable along the recessed grooves 46, whereby the guide frame 8 is assembled with the holding frame 7 in a state of not being detached therefrom with ease.

The coupling portion 13 of the above-described guide frame 8 is composed of two walls 13*a* and 13*b* individually arranged on both sides of the guide frame 8 in the front-and-rear direction B perpendicular to the longitudinal direction A thereof. One end of each of the walls 13*a* and 13*b* in the longitudinal direction A is made to continue with a bottom surface portion of one of the frame portions 12, and the other end of each of the walls 13*a* and 13*b* in the longitudinal direction A is made to continue with a portion of the other frame portion 12. In FIG. 3, the coupling portion 13 is composed of two walls, which are the one wall 13*a* on the front side, and the one wall 13*b* on the rear side, and the outer member frame 2 that fixes the outer member 1 thereto is adapted to be arranged between the two walls 13*a* and 13*b*. Note that the number of walls 13*a* and 13*b* is not particularly limited, and is freely changeable as appropriate.

Moreover, as shown in FIG. 3, the coupling portions 9 of the above-described guide frame 8 are formed into hooks which protrude inward from both ends of the guide frame 8 in the longitudinal direction A. Hooks 47 provided on both ends of the outer member frame 2 in the longitudinal direction A are hung on the hook-like coupling portions 9, whereby the outer member frame 2 and the guide frame 8 are adapted to be coupled to each other.

Then, in the event of assembling the finish shaving blade block 6 (outer member block 6A and inner member block 6B) having the above-described configuration, the outer member block 6A is assembled in advance by fixing the outer member 1 and the outer member frame 2 to each other in the heat-sealing manner. Hence, spring urging force from the inner member push-up springs 5 is not applied to the outer member 1 at the time of assembling the outer member 1 and the holding frame 7 with each other. Accordingly, even in a case where rigidity of the outer member 1 is not only high but also low, it becomes possible to couple the outer member 1 to the outer member frame 2 without deforming the outer member 1, and the assembly of the outer member block 6A can be performed with ease. Thereafter, in a state where lower ends of the inner member push-up springs 5 are supported by the spring receiving portions 10 of the guide frame 8, and where upper ends of the inner member push-up springs 5 are fitted into the spring receiving portions 60 of the inner member joint 4 fixedly attached integrally with the inner member 3, the hooks 47 provided on both ends of the outer member frame 2 in the longitudinal direction A are coupled to the hook-like coupling portions 9 provided on both ends of the guide frame 8 in the longitudinal direction A so as to cover the inner member 3 with the outer member 1 of the above-described outer member block 6A. In such a way, the finish shaving blade block 6 is completed.

Moreover, in the guide frame 8 of this example, the pair of frame portions 12 and the coupling portion 13 are integrated together, and accordingly, strength of the guide frame 8 is enhanced, and coupling strength of the outer member frame 2 to the guide frame 8 is increased following this enhancement. In addition, both front and rear surfaces of the outer member frame 2 can be sandwiched by the two front and rear walls 13*a* and 13*b* which compose the coupling portion 13 of the guide frame 8, and moreover, the coupling strength of the outer member frame 2 to the guide frame 8 and stability of the outer member frame 2 can be enhanced in such a manner that the two front and rear walls 13*a* and 13*b* are differentiated in height from each other in the vertical direction. Furthermore, an opening width between the front and rear walls 13*a* and 13*b* different in height from each other is widened, whereby it becomes easy to insert the outer member frame 2 therebetween, and further, attached positions of the inner member push-up springs 5 become much easier to see, leading to an advantage that reliability thereof in assembly is enhanced to a large extent. In addition, the coupling portions 9 are individually provided on both ends of the guide frame 8 in the longitudinal direction A, and the hooks 47 are individually provided on both ends of the outer member frame 2 in the longitudinal direction A, and accordingly, the coupling between the guide frame 8 and the outer member frame 2 will be performed on both end sides in the longitudinal direction A. In such a way, a thickness of each of the outer member frame 2 and the guide frame 8 in the front-and-rear direction B can be reduced, leading to an advantage that thinning and downsizing of the finish shaving blade block 6 can be performed with ease.

Figure 5:
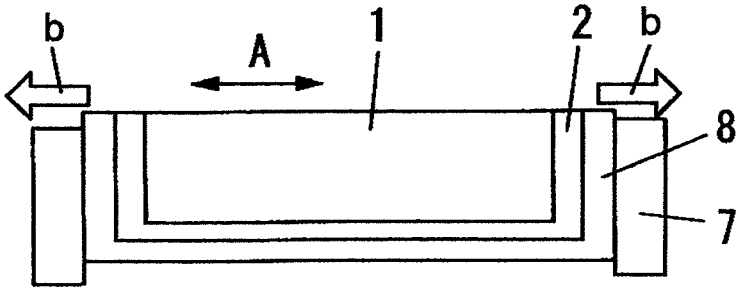
FIG. 5 is a schematic configuration view showing a case of inhibiting the guide frame from opening in a longitudinal direction by the holding frame provided on a shaver body according to the first embodiment of the present invention.

Furthermore, a structure is adopted, in which, in a state where the guide frame 8 is held on the holding frame 7 provided on the shaver body after the assembly, the holding frame 7 inhibits an expansion of the guide frame 8 in the longitudinal direction a (in a direction of an arrow b of FIG. 5). In such a way, the expansion of the guide frame 8 is forcibly inhibited by the holding frame 7, and accordingly, there is another advantage that the reliability in assembly can be enhanced more.

Furthermore, at the time of replacing the finish shaving blade block 6 (one or both of the outer member block 6A and the inner member block 6B), there is still another advantage that the replacement can be performed with ease in such a manner that the finish shaving blade block 6 is detached from the holding frame 7 together with the guide frame 8, and that the blade block 6 is detached from the guide frame 8.

Second Embodiment

Figure 6:
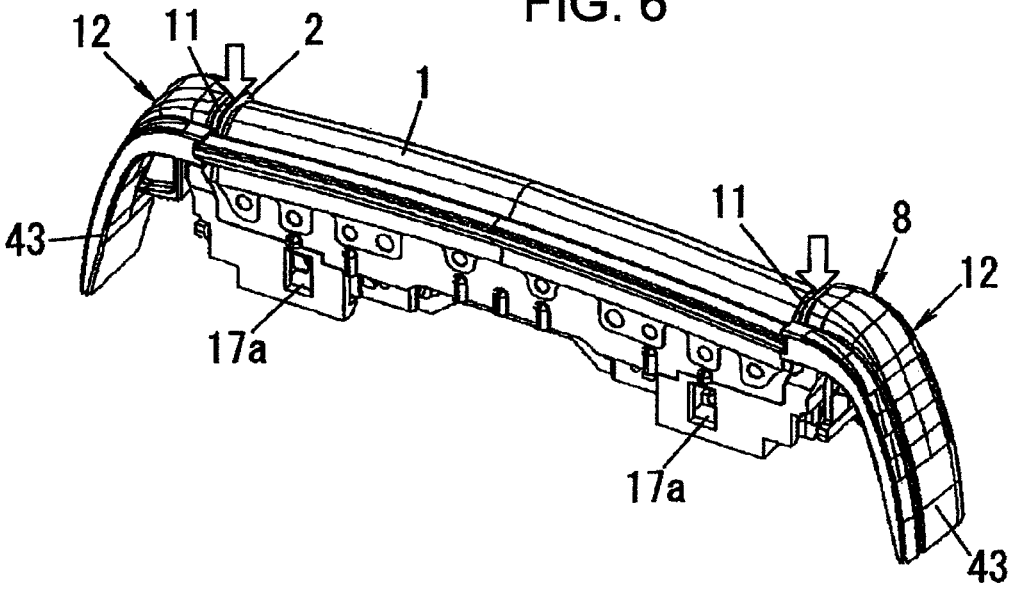
FIG. 6 is a perspective view showing a structure according to a second embodiment of the present invention, in which it is made possible to couple an outer member frame that fixes the outer member thereto to a coupling portion of the guide frame.

In this embodiment, a structure is adopted, in which pressing portions 11 which protrude upward from a front surface of the outer member 1 are individually provided on upper portions on both ends of the above-described outer member frame 2 in the longitudinal direction A, and the outer member frame 2 is pressed through the pressing portions 11, whereby it is made possible to couple the outer member frame 2 that fixes the outer member 1 thereto to the coupling portions 9 of the guide frame 8. Other configurations are similar to those of the above-mentioned first embodiment. Note that, in FIG. 6, illustration of the inner member 3 and the inner member push-up springs 5 is omitted. In accordance with this embodiment, the outer member 1 and the outer member frame 2 are assembled with each other by pushing the pressing members 11 indicated by arrows of FIG. 6 at the time of the assembly, whereby the outer member 1 and the outer member frame 2 can be assembled with each other without directly pushing the outer member 1. Accordingly, the outer member 1 is not deformed, leading to an advantage that it becomes easy to assemble the outer member 1 with the outer member frame 2.

Third Embodiment

Figure 4:
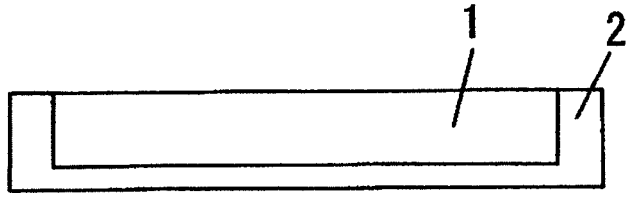
FIG. 4 shows the first embodiment of the present invention.
Figure 4:
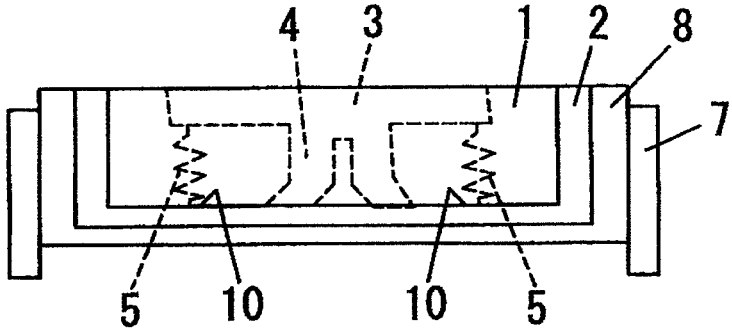
Figure 7:
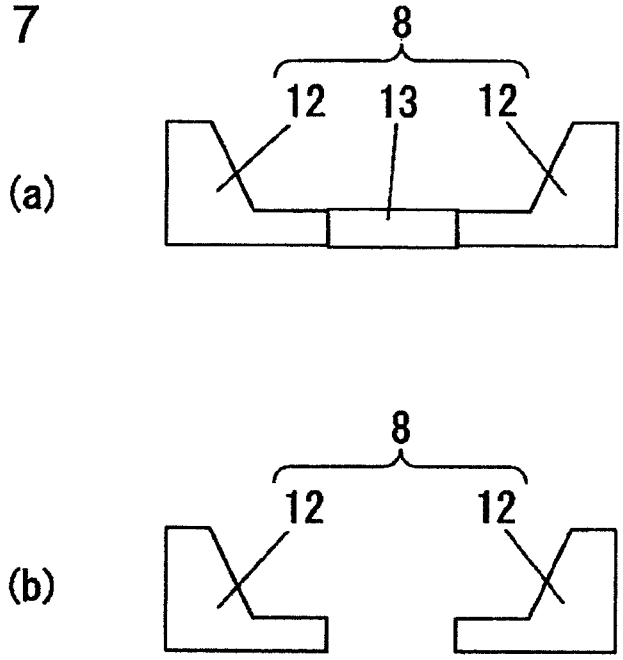
FIG. 7 shows the guide frame according to the present invention.

Moreover, in the above-described embodiments, the description has been made of the case where, as the guide frame 8, the pair of frame portions 12 are integrated with each other while interposing the coupling portion 13 therebetween as shown in FIG. 7(*a*); however, as in this embodiment, the guide frame 8 may be composed of a right and left pair of frame portions 12 separate from each other without using the coupling portion 13, and the coupling portion 9 and the spring receiving portion 10 may be provided on each of the frame portions 12 (refer to FIG. 7(*b*)). Specifically, the coupling portions 9 shown in FIG. 3 and FIG. 4 are individually provided on the inner surfaces of the respective frame portions 12, the guide protrusions 45 are individually provided on the outer surfaces of the respective frame portions 12, and the spring receiving portions 10 are individually provided on bottom surface portions of the respective frame portions 12, which are extended in the longitudinal direction A from the lower ends thereof. As described above, the guide frame 8 is separated right and left from each other, whereby downsizing of the guide frame 8 is achieved, and following this downsizing, it becomes much easier to assemble the guide frame 8 with the finish shaving blade block 6.

Fourth Embodiment

Figure 8:
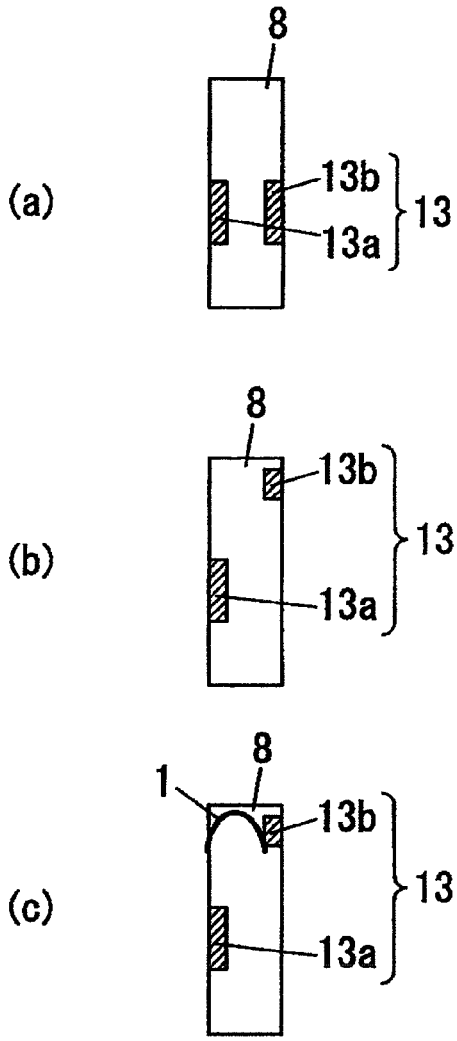
FIG. 8 shows a fourth embodiment of the present invention.

In this embodiment, as shown in FIG. 8, a mode of arranging the walls 13*a* and 13*b* individually arranged on both sides of the guide frame 8 in the front-and-rear direction B is differentiated in a case where the coupling portion 13 of the above-described guide frame 8 is composed of the two walls 13*a* and 13*b* concerned. Specifically, FIG. 8(*a*) shows a case where the two front and rear walls 13*a* and 13*b* are arranged at the same height, FIG. 8(*b*) shows a case where the two front and rear walls 13*a* and 13*b* are arranged at heights different from each other in the vertical direction, and FIG. 8(*c*) shows a case where the one wall 13*b* on the rear side is arranged along a side surface of the outer member 1. First, in the case of FIG. 8(*a*), it becomes possible to support both front and rear surfaces of the outer member frame 2 individually by the walls 13*a* and 13*b*. Moreover, in the case of FIG. 8(*b*), as mentioned in the above-described first embodiment, the enhancement of the coupling strength of the outer member frame 2 to the guide frame 8 and the enhancement of the stability of the outer member frame 2 are achieved. Furthermore, in the case of FIG. 8(*c*), there is an advantage that, at the time of shaving, the skin can be prevented from strongly touching the outer member 1 by the wall 13*b* arranged on the side surface of the outer member 1.

Fifth Embodiment

Figure 9:
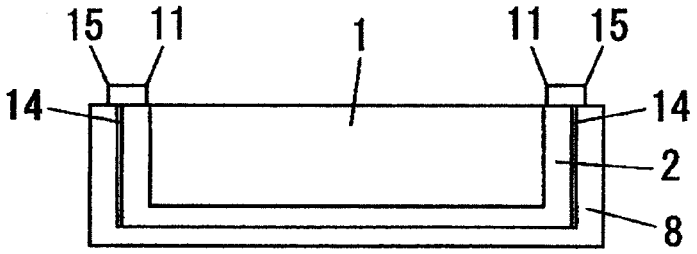
FIG. 9 is a schematic configuration view of a case according to a fifth embodiment of the present invention, where cover portions which individually cover gaps between the outer member frame and the guide frame from above are protruded on both ends of the outer member frame in the longitudinal direction.
Figure 10:
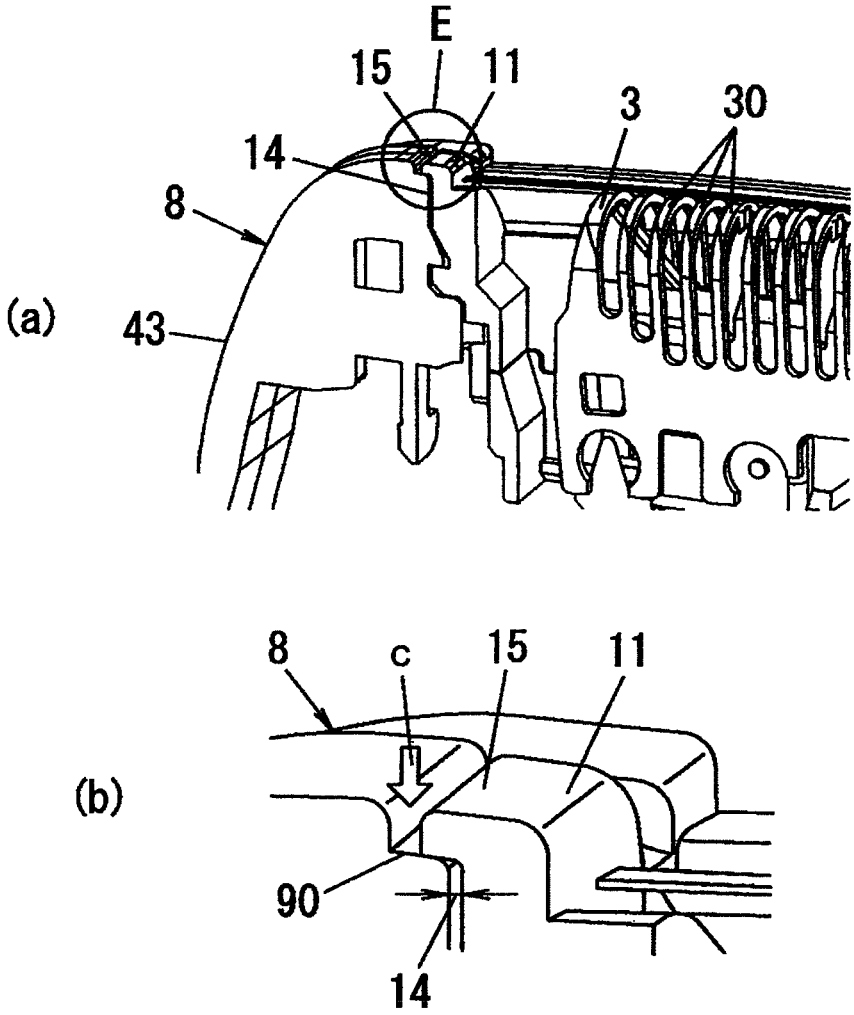
FIG. 10 shows the fifth embodiment of the present invention.

In this embodiment, as shown in FIG. 9, cover portions 15 which individually cover gaps 14 between the outer member frame 2 and the guide frame 8 from above are protruded on both ends of the outer member frame 2 in the longitudinal direction A. Other configurations are similar to those of the above-described first embodiment. Specifically, as shown in FIG. 10, the pressing portions 11 (FIG. 6) provided on both ends of the outer member frame 2 in the longitudinal direction A are extended further outward, and tip ends of the extended portions are defined as the cover portions 15. Moreover, on upper portions on both ends of the guide frame 8 in the longitudinal direction A, horizontal step portions 90 which are lowered by one step are individually provided, and the cover portions 15 engage with upper surfaces of the step portions 90, whereby a state is brought, where the gaps 14 between the guide frame 8 and the outer member frame 2 are covered with the cover portions 15. In such a way, relatively long beard and hair can be prevented from entering depths of the gaps 14 from an arrow direction c, effectively preventing "beard pulling (that the long hair and beard enter the gaps 14 and are pulled)". Moreover, the gaps 14 are surely isolated from the outside by the cover portions 15 and the step portions 90, and accordingly, the prevention of the beard pulling is surely carried out. Furthermore, the cover portions 15 are arranged on extensions of the pressing portions 11, and accordingly, the cover portions will have a function as the pressing portions 11, whereby an area of each of the pressing portions 11 is increased. As a result, in the event of assembling the outer member frame 2 and the guide frame 8 with each other by pressing, from above, the pressing portions 11 indicated by the arrows of FIG. 6 described above at the time of the assembly, since the area of each of the pressing portions 11 is large, the pressing portions 11 can be surely pushed, thus making it possible to further enhance assembly easiness of the outer member frame 2 and the guide frame 8.

Sixth Embodiment

Figure 11:
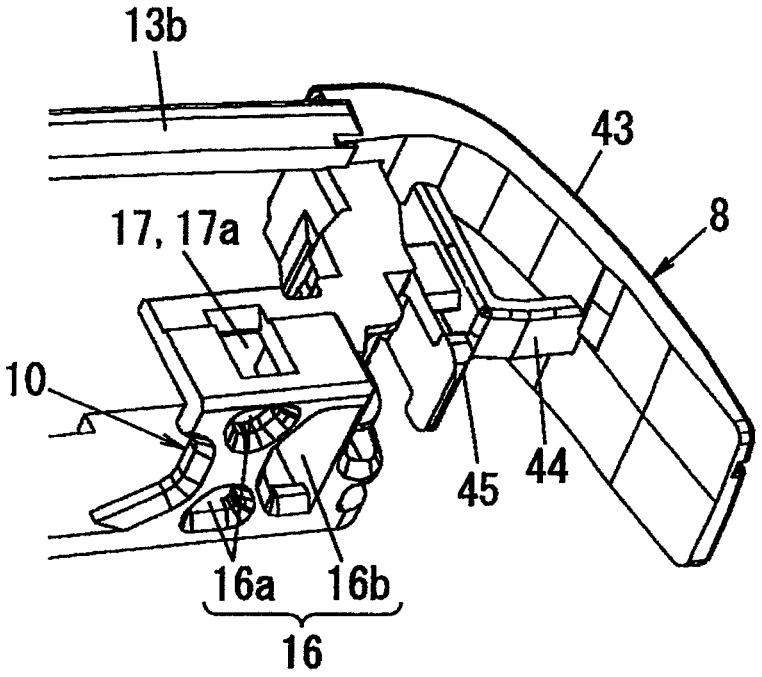
FIG. 11 is a perspective view explaining holes according to a sixth embodiment of the present invention, in which, in one of frame portions of the guide frame, holes are open downward and viewed from below and holes are open in a front-and-rear direction and viewed from below.

In this embodiment, in the vicinities of the spring receiving portions 10 in the frame portions 12 of the guide frame 8, holes 16 open downward and holes 17 open in the front-and-rear direction are individually provided. Other configurations are similar to those of the above-described first embodiment. As shown in FIG. 11, the holes 16 open downward are composed of two small circular holes 16*a* and 16*a* and one large semicircular hole 16*b*, which are provided in three spots surrounding the periphery of a lower surface of the spring receiving portion 10. Meanwhile, the holes 17 are composed of two rectangular holes 17*a* and 17*a* individually provided in spots of front and rear surfaces of the spring receiving portion 10. Moreover, these respective holes 16 and 17 are individually provided in the right and left spring portions 10 of the guide frame 8. Then, beard waste drops down from the holes 16 (three on each of the right and left sides, six in total) open downward, and is discharged forward or rearward from the holes 17 (two on the front and rear sides, two on the right and left sides, four in total), and accordingly, it becomes possible to prevent the beard waste from being accumulated in an inside of the guide frame 8. Furthermore, at the time of the assembly, it becomes possible to easily confirm an attached state of the inner member push-up springs 5 from below or in the front-and-rear direction through the holes 16 and 17, and the enhancement of the reliability in assembly can be achieved.

Note that, in each of the embodiments described above, as the blade heads of the reciprocating electric shaver, the four blades shown in FIG. 2 have been illustrated, in which the two auxiliary blade heads are arranged between the two main blade heads 21 and 22; however, the blade heads are not limited to this configuration, and for example, the blade heads may be three blades in which the one auxiliary blade head (finish shaving blade block 6) is arranged between the two main blade heads 21 and 22.

INDUSTRIAL APPLICABILITY

In accordance with the present invention, the new guide frame for enabling even the outer member with low rigidity to be assembled with the holding frame is used, whereby the blade of the reciprocating electric shaver, which has the outer member with low rigidity, can be obtained.

The invention claimed is:

1. A blade of a reciprocating electric shaver, which includes an outer member, an outer member frame that fixes the outer member thereto, an inner member arranged under a lower surface of the outer member, an inner member joint attached to the inner member, and inner member push-up springs which press the inner member toward an inner surface of the outer member, the blade comprising:

a holding frame, and a guide frame, guide protrusions and ribs provided on the guide frame, and engagement protrusions provided on the holding frame, and recessed grooves provided on the holding frame, the ribs received in the recessed grooves and the engagement protrusions engaged with the guide protrusions such that the guide frame is freely floatably held on the holding frame, wherein, in the guide frame, there are provided: coupling portions to which the outer member frame that fixes the outer member thereto is coupled; and spring receiving portions which support lower ends of the inner member push-up springs, wherein the coupling portions include projecting coupling portions on the guide frame, and hooks on both ends of the outer member frame.

2. The blade of a reciprocating electric shaver according to claim 1, the inner member extending in a longitudinal direction and being reciprocable in the longitudinal direction, wherein the coupling portions are individually arranged on both ends of the guide frame in the longitudinal direction along the reciprocating direction of the inner member, and both ends of the outer member frame in the longitudinal direction are coupled to the coupling portions.

3. The blade of a reciprocating electric shaver according to claim 1, the inner member extending in a longitudinal direction and being reciprocable in the longitudinal direction, wherein the holding frame holds the guide frame in the longitudinal direction along the reciprocating direction of the inner member.

4. The blade of a reciprocating electric shaver according to claim 1, wherein, in the guide frame, a pair of frame portions located on both ends thereof in a longitudinal direction and a frame portion coupling portion that couples the pair of frame portions to each other are formed integrally with one another, and the frame portion coupling portion and the spring receiving portion are provided on each of the frame portions.

5. The blade of a reciprocating electric shaver according to claim 4, wherein the coupling portion is composed of plural walls individually arranged on both sides of the guide frame in a front-and-rear direction perpendicular to the longitudinal direction thereof.

6. The blade of a reciprocating electric shaver according to claim 5, wherein the plural walls individually arranged on both sides of the guide frame in the front-and-rear direction are arranged at heights different from each other in a vertical direction.

7. The blade of a reciprocating electric shaver according to claim 6, wherein at least one wall of the plural walls individually arranged on both sides of the guide frame in the front-and-rear direction is arranged along a side surface of the outer member.

8. The blade of a reciprocating electric shaver according to claim 1, wherein pressing portions which protrude from a front surface of the outer member are individually provided on upper portions on both ends of the outer member frame in a longitudinal direction that goes along a reciprocating direction of the inner member, and the outer member frame is pressed through the pressing portions, whereby it is made possible to couple the outer member frame that fixes the outer member thereto to the coupling portions of the guide frame.

9. The blade of a reciprocating electric shaver according to claim 1, wherein the guide frame is composed of a right and left pair of frame portions separate from each other, and the coupling portion and the spring receiving portion are provided on each of the frame portions.

10. The blade of a reciprocating electric shaver according to claim 1, wherein cover portions which cover gaps between the outer member frame and the guide frame from above are protruded on both ends of the outer member frame in a longitudinal direction that goes along a reciprocating direction of the inner member.

11. The blade of a reciprocating electric shaver according to claim 1, wherein holes open downward are provided in vicinities of the spring receiving portions of the guide frame.

12. The blade of a reciprocating electric shaver according to claim 1, wherein holes open in a front-and-rear direction of the guide frame are provided in vicinities of the spring receiving portions of the guide frame.

* * * * *